US006161738A

United States Patent [19]

Norris

[11] Patent Number: 6,161,738

[45] Date of Patent: Dec. 19, 2000

[54] BAG STYLE CONTAINER WITH BULLET RESISTANT DEPLOYABLE PANELS

[76] Inventor: Gail Norris, 1864 Clove St., San Diego, Calif. 92106

[21] Appl. No.: 09/352,009

[22] Filed: Jul. 12, 1999

[51] Int. Cl.[7] ..... A45C 9/00; A45F 3/08

[52] U.S. Cl. ..... 224/153; 109/49.5; 150/119; 383/40; 383/119

[58] Field of Search ..... 2/2.5; 109/49.5; 150/117, 118, 119; 206/521, 521.5, 523, 594; 220/560.01, 900; 224/153, 627, 645; 229/122.2; 383/38, 40, 119

[56] References Cited

U.S. PATENT DOCUMENTS

| | | | |
|---|---|---|---|
| 1,434,926 | 9/1922 | Stember | 150/114 |
| 3,061,839 | 11/1962 | Foster | 2/2.5 |
| 3,117,607 | 1/1964 | Siegel | 150/117 |
| 3,762,345 | 10/1973 | Sgariglia, Jr. | 109/22 X |
| 3,884,380 | 5/1975 | Prochnow et al. | 220/9 |
| 4,546,863 | 10/1985 | Kaufman | 190/102 |
| 4,830,245 | 5/1989 | Arakaki | 224/210 |
| 4,919,037 | 4/1990 | Mitchell | 89/36.05 |
| 5,031,733 | 7/1991 | Chang | 190/1 |
| 5,149,203 | 9/1992 | Sacks | 383/111 |
| 5,747,721 | 5/1998 | Speakes et al. | 89/36.11 |
| 5,865,314 | 2/1999 | Jacober | 150/117 |

*Primary Examiner*—Gary E. Elkins
*Attorney, Agent, or Firm*—Donn K. Harms

[57] ABSTRACT

A combination container for transporting articles which can concurrently be used as a ballistic shield from high speed projectiles such as bullets and/or shrapnel. The container, which can be a backpack, purse, computer carrying case, or similar bag style device, features a forward wall and a rear wall each having forming a compartment therebetween and at least one ballistic shield, attachable to one or both of the forward wall and said rear wall. Upper flaps and lower flaps attached to the bag afford deployable additional protection from attached ballistic shields. A handle provides a means for elevating the deployed elongated flaps and attached bag in front of the user to provide a large area of protection from such high speed projectiles.

13 Claims, 2 Drawing Sheets

BAG STYLE CONTAINER WITH BULLET RESISTANT DEPLOYABLE PANELS

BACKGROUND OF THE INVENTION

1. Field of the Invention

The present invention relates to shoulder or hand carried bag style containers. More particularly, it relates to backpacks and handbags with a bullet resistant side and deployable panels which are also bullet-resistant to increase the coverage area afforded the user trying to protect themselves from possible harm from bullets or other high velocity projectiles which might be directed toward the user.

2. Prior Art

It is a sad state in current society that crimes committed by persons with guns are continually high in volume of occurrence. Police officers and members of the military have long been the victims of the occupational hazard of gunfire directed toward them during work or duty. From this constant danger to life and limb from the risk of gunshot wounds came the bullet resistant vest which is conventionally worn on the user's body from shoulder to waist. Such devices, when used to deter weapon fire of a caliber from which they are designed to protect, work quite well in preventing a high velocity bullet or shell from penetrating the wearer's body.

However one new risk to human life and health has occurred in venues where the risk of death or injury from bullet wounds was never intended to be a risk. In recent years, students attending colleges, high schools, and junior high, have suddenly come under fire from attackers carrying and discharging firearms on school grounds.

Considering the number of schools in the United States, it might seem statistically rare that a student would risk life and limb while attending school from a potential gunshot wound. However, just like an airplane crash is statistically rare, when it does happen, a victim needs all of the protection available against the threat to increase the chances of surviving the event.

Bullet resistant vests worn by the military and police officers offer good protection of the upper body but are not practical for students to wear to school. They are hot, unfashionable, constraining, and considering the statistical risk of harm from a gunshot wound at school, probably more of an irritant than they are worth. Further, wearing of such devices may be prohibited under some school district rules or state laws.

As is obvious, the current escalation in school violence and street violence encountered by students on the way home does warrant some form of protection that is readily available to the student should the need arise. Such protection should not cause the physical discomfort of currently manufactured vests and body armor and should be discreetly deployable if the need arises. Such a device should also offer options in the area of coverage when deployed and additionally offer protection in relation to the threat.

Further, such a device should not just be discretely available to students, but should also be deployable to homemakers, and working men and women who might feel the need to afford themselves protection against the risk of gunshot injury.

U.S. Pat. No. 4,830,245 (Arakai) teaches a backpack carrier and shield combination. However, Arakai requires a metal frame which is stiff and impractical to wear and offers no option to the wearer for enlargement of the protected area.

U.S. Pat. No. 5,059,467 (Berkovitz) teaches a body protection system using glass fibers or ballistic nylon to protect the user. However, Berkovitz, much like other art in this area, teaches no optional enlargement of the protection area nor the ability to wear the device in a removable backpack or purse in a discrete fashion.

Other art in the bullet or ballistic projectile area is similar in fashion and fails to teach or claim a discrete, easily removable, and easily enlargeable bullet or shrapnel protection system.

As such, there exists a need for an easily and inexpensively manufactured apparatus which can be easily carried by a user in normal daily activities. The device should be discrete, yet readily deployable by the user to protect against an actual or potential threat of severe injury from gunshot wounds. The device should also offer varying degrees of increasing protection or upgrade ability should the user determine that more protection is needed in their environment at work, school, or home.

SUMMARY OF THE INVENTION

Applicant's device is an easily manufactured and carried bag style container which can be made in a number of styles which are commonly used by students, homemakers, executives, and travelers. The use of a bag style container thereby provides the discreteness valued by users not wishing to call attention to themselves during such an attachment since the device can be manufactured in a number of embodiments. Such embodiments include a handbag or purse, a backpack, or a computer or travel bag, all commonly used bags which attract little, if any, attention from potential attackers. Such common bag style containers can also be customized externally by manufacturers to yield the certain trendy look or style valued by student and homemaker alike, or, the device might also be manufactured in the very plain style of a backpack or laptop computer bag.

The device consists of one of the aforementioned styles of bag having the requisite hand or shoulder straps attached to the appropriate area of the device to allow it to be easily carried. Additionally, the device features one or a plurality of ballistic shields which can be permanently attached to the fabric of the bag, or, inserted into a holding means such as a pocket in a sidewall or flap of the bag.

Commonly, the device would feature a handbag or backpack style bag having one side panel that has a ballistic shield attached to it. This first ballistic shield would provide an area of protection to the user that would be substantially equal to the size of the side of the bag. Additional protection can be afforded the user by the addition of one or a plurality of deployable flaps on the bag. These deployable flaps would be attached at one end to the bag itself and easily detachable from the bag at the other end of the flap. Thus the flap can be detached from the bag at the distal end when the need arises and unfolded to be elongated. The protection afforded the user would thereby be increased by the area of one or a plurality of such deployable panels when so deployed.

Additional utility is provided by the attachment of a handle means to user facing side of one of the deployable panels. Such a handle means would allow the user, when deploying the flap, to maintain the flap in an extended position, by holding the handle means with a hand, and raising it above their head. Consequently, the forward or rear wall of the bag would protect the torso area of the user and the deployable flap so extended would protect the head and neck.

Should even more protection be desired such can be afforded the user by the addition of another user deployable flap that will drop down below the surface area of the bag during deployment. This second deployable flap would thereby protect the legs. If both flaps are provided and deployed by the user during a threat from a firearm, the user would have a shield extending from above the raised hand to below the waist and even lower if the deployable panels are dimensioned to be so elongated when deployed.

An object of this invention is to provide a shield against the threat of injury from a bullet or other firearm style weapon.

Another object of this invention is to provide such a ballistic shield that is expandable to thereby provide more area of coverage against bodily harm from a firearm attack.

A further object of this invention is the provision of such a shield from bullets that is capable of manufacture in a stylish manner to encourage its use by fashion conscious users.

An additional object of this invention is the provision of a bullet shielding device that is discrete and thereby will not call attention to the user should an attack occur.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
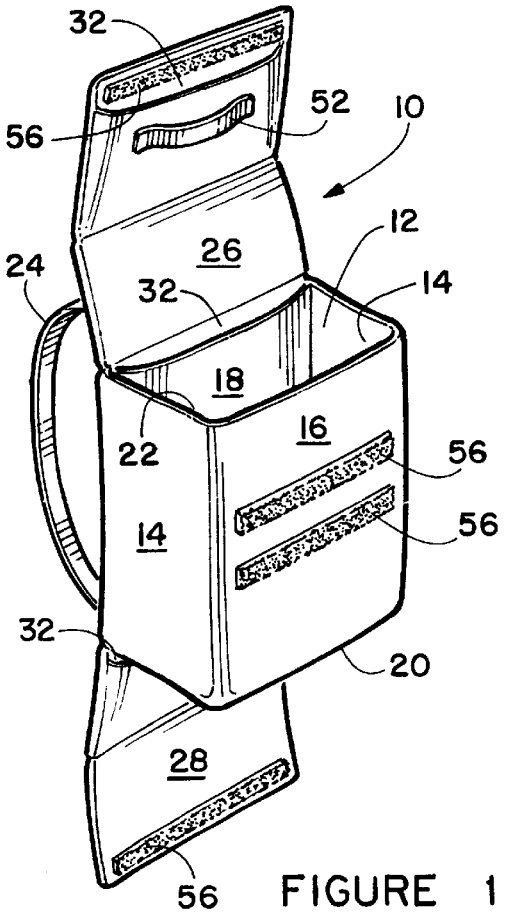
FIG. 1 is a perspective view of the bag style device showing a plurality of deployable shields in the deployed position.
Figure 2:
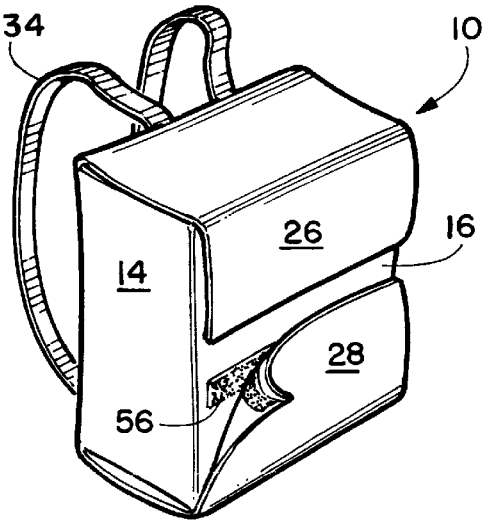
FIG. 2 is a perspective view of the bag style device showing the deployable shields stored in their mounted positions on the device.
Figure 3:
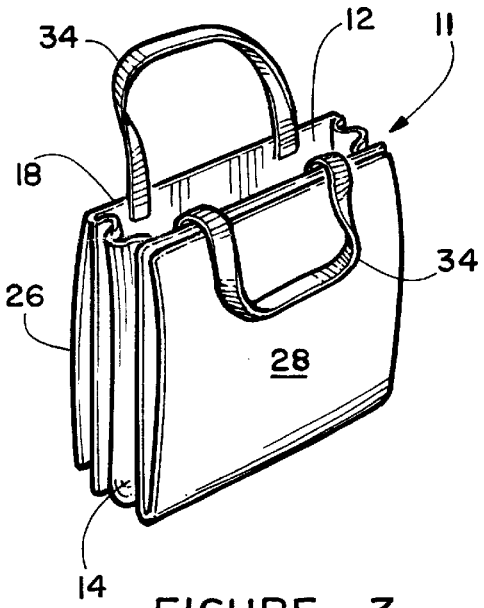
FIG. 3 is a perspective side view a handbag embodiment of the applicant's device with the deployable shields stored.
Figure 4:
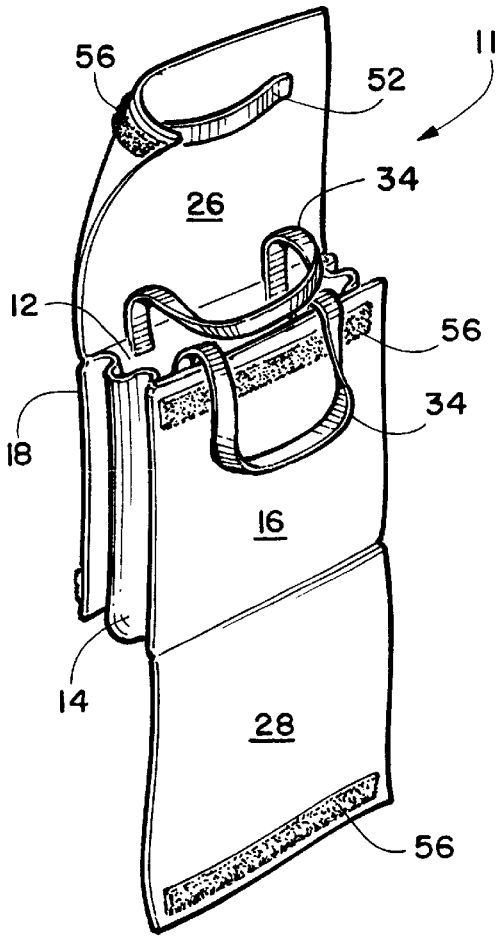
FIG. 4 is a perspective view of the device in FIG. 3 with the additional shield panels deployed.
Figure 5:
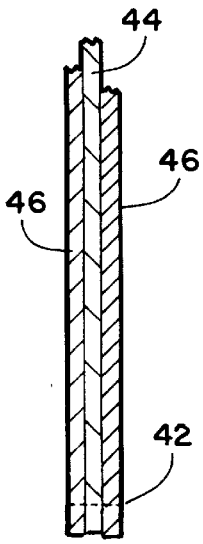
FIG. 5 is a side cut away view depicting the ballistic shield material enclosed by a sidewall of the bag.
Figure 6:
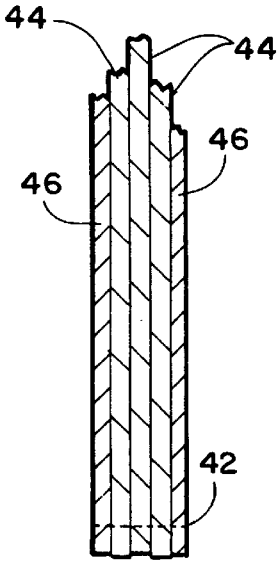
FIG. 6 depicts a plurality of layers of ballistic shield material contained between two fabric sidewalls.
Figure 7:
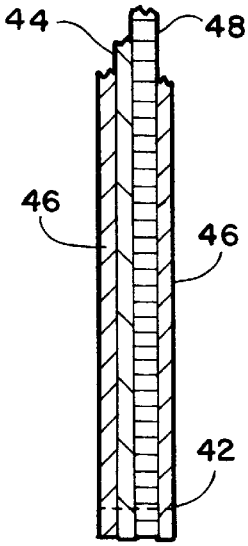
FIG. 7 depicts a side cut away view of the ballistic shield material in between a shock absorbing layer of material both of which are between two layers of fabric.
Figure 8:
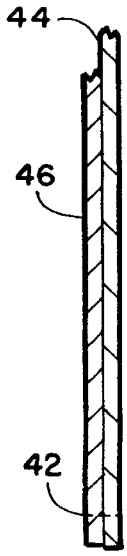
FIG. 8 depicts a side cut away view of the ballistic fabric attached to one layer of fabric.
Figure 9:
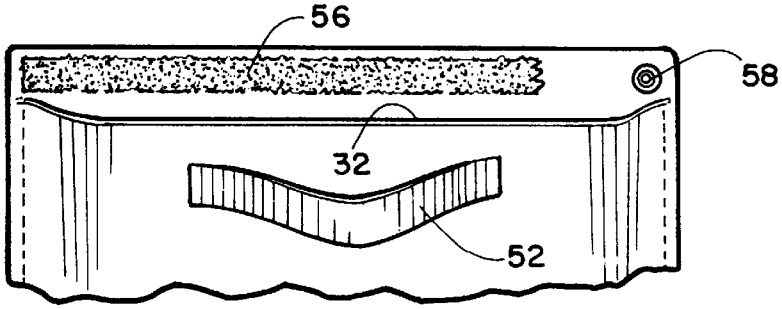
FIG. 9 depicts the distal end of a deployable shield panel.
Figure 10:
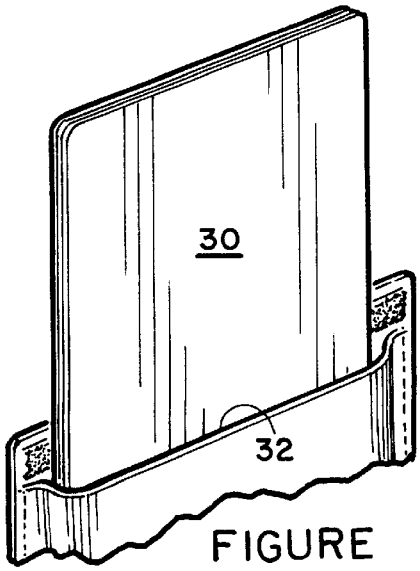
FIG. 10 depicts the shield material being inserted into a holding pocket in a sidewall or deployable shield portion.
Figure 11:
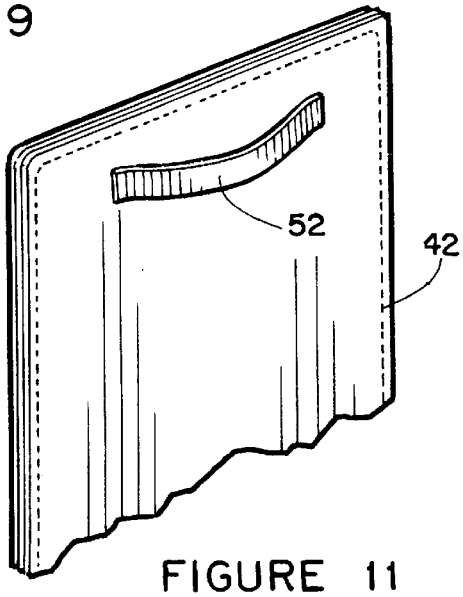
FIG. 11 depicts the shield material sewn to the bag material on one side.

Referring now to the drawing figures, specifically FIGS. 1 through 11 depict preferred embodiments of the invention herein disclosed and the construction and operation thereof.

The backpack style embodiment of the bag style device 10 offers the conventional components enjoyed by users of backpacks in that it has an internal compartment 12 for carrying of books, papers, and other personal belongings. The compartment 12 can be one large compartment 12 as depicted or it can be divided into smaller sub-compartments for organizational purposes.

The compartment 12 is defined by a rear wall 16 which is substantially parallel to a forward wall 18. The rear wall 16 and the forward wall 18 are joined at their periphery edges by a means of joining said periphery edges which in this case is accomplished by sewing such to a pair of sidewalls 14 and a bottom wall 20. As depicted in figure one, this manner of joining the forward wall 18 to the rear wall 16 provides a larger and more cube like compartment 12. However, the forward wall 18 might also be joined directly to the rear wall 16 about the periphery by sewing it directly thereto and eliminating either the sidewalls 14 or the bottom wall 20 or both.

In the backpack embodiment depicted in FIG. 1, the rear wall 16 and forward wall 18 are attached a means of attachment of the periphery edges in the conventional manner of a back pack or other shoulder carried bag for carrying books, clothes, or personal items inside and interior compartment 12. Such bags are currently sewn, heat sealed, glued, and otherwise assembled. An orifice 22 is formed on one end of the device 10 the size of which is determined by the dimensions of the forward wall 18 and rear wall 16 and will be even larger if the sidewalls 14 are included. The sidewalls 14, rear wall 16, forward wall 18, bottom wall 20, and other exterior and interior parts of this embodiment and others noted herein are made from conventional fabrics used to manufacture backpacks and luggage such as woven or knitted nylon or polyester fabric, vinyl, leather, or other conventional fabrics used to manufacture backpacks, luggage, gym bags, purses and the like. Just as in the orifice 22, the size of the internal compartment 12 is defined by the dimensions of, and number of included adjacent walls. A means for carrying the bag style device is provided by one or a plurality of carrying straps 24 are attached to the device 10 to allow for carrying of the device 10 by gripping he straps 24 in the hand or placing them one or two shoulders. Of course, other types of carrying means may also be incorporated such as handles 34 in the case of a purse style bag 11.

Most such bag style devices have a top flap 26 which is dimensioned to at least cover the orifice 22 which communicates with and provides access to the internal compartment 12. The optional top flap 26 in conventional backpacks, purses, gymbags, computer bags, and the like is generally just to provide a barrier to retain the contents in the compartment 12 and to keep others from reaching into the compartment 12.

In the various embodiments of the device herein disclosed, the top flap 26 provides an additional and important function as does the adjacent forward wall 18 and optional adjacent bottom flap 28 to the user. The top flap 26, forward wall 18 and optional bottom flap 26 employ a means for stopping a high speed projectile, such as a bullet or shrapnel from a bomb, in the depicted form of a ballistic shield 30. This ballistic shield is attached to the various walls using a means of attachment of the ballistic shield 30 in the form of a pocket 32 formed in the wall for the insertion of the ballistic shield 30 therein or attachment of the ballistic shield 30 by sewing 42 to the interior or one sidewall of the top flap 26, forward wall 18 or optional bottom flap 28 as the case may be. Other means of attachment of the ballistic shield 30 would be obvious to those skilled in the art and such means of attachment of the ballistic shield are anticipated. However, the current best mode of the device uses textile fabric to form the ballistic shield 30 due to the inherent flexibility and lightweight characteristics of such material. As such, sewing it to, or into the top flap 26, and/or the forward wall 18 and/or the bottom flap 28, or sewing thicknesses of the textile material together and inserting same into a pocket formed in the top flap 26 and/or the forward wall 18 and/or the bottom flap 28 are the current best modes of the device.

The ballistic shield 30 is best formed of flexible textile armor shielding material that is resistant, and in some cases impervious, to penetration by the anticipated bullet or other projectile traveling at high speed. Such material includes, but is not limited to, one or a combination of textile materials from a group consisting of fabrics including bullet resistant textile fabric, Kevlar®, Twaron®, and Zylon® and a more recently derived material of composed of natural or synthetic spider web materials. Should a stiff or solid ballistic shield 30 be used, it can be formed of panels including one or a combination of materials from a group consisting of high density plastic, steel, aluminum, resin composite material, titanium, and similar materials which will stop or impede a bullet or similar high speed projectile. However, the more flexible textile fabrics would be the best mode of the current device.

As disclosed herein, the ballistic shield 30 is formed of the material appropriate to the purpose and may be attached to the walls of the device by means of attachment of the ballistic shield which includes inserting it into a pocket 32 formed in the appropriate wall of the device, or in the case of textile fabric, one or multiple layers of such ballistic resistant textile fabric 44 may be sewn together and inserted into the pocket 32, or may be sewn to, or into, the conventional bag fabric 46 forming the wall to which the ballistic shield 30 is to be attached. When using ballistic resistant textile fabric 48 to compose the ballistic shield 30, one or a plurality of layers of the ballistic resistant textile fabric 44 may be combined to achieve the level of ballistic resistant shield 30 sufficient for the purpose intended. As noted earlier, the current best mode features the ballistic resistant textile fabrics 44 to form the shield 30, however, if desired, the rigid type of shield might also be combined with the ballistic resistant textile fabric 44 to form the ballistic shield 30.

Of course, conventional fasteners or glue might also be used as a means for attachment of the ballistic shield, however, the current best mode features the ballistic shield 30 being inserted into a pocket 32 which may then be sealed, or by directly sewing the ballistic shield 30 to, or in between, the textile bag fabric layers 46 forming the bag walls.

If sewn to the walls of the device, instead of inserted into the pocket 32, conventional stitching 42 would be used through the layers of ballistic resistant 44 and the textile used for the bag 46.

In use, the backpack embodiment of the device 10 inherently provides protection to the user's back when worn with the straps 34 worn over the shoulder in the conventional fashion. This is because the ballistic shield 30 is attached to one or a combination of the forward wall 18 and the rear wall 16. When attached to the rear wall 16, additional protection is afforded the user from the contents of the bag acting as a pad should a bullet or projectile hit the rear wall 16, or, if additional padding and protection from blunt force of the projectile hitting the shield 30 in any of the panels or walls where the shield 30 is employed, a means of blunt force absorption may be added adjacent to the ballistic shield 30. Such a means of blunt force absorption would currently best be formed by shock absorbent material 52 currently used to pad the feet of runners and race horses such as Sorbathene® or similar material with high impact absorption properties.

Additional protection during use is provided by the deployable top flap 26 which has attached a means to hold the bag style device 10 or 11 elevated, with the top flap 26 deployed in the elongated position, in the form of a handle 52. If the occasion should arise where use of the device for protection is needed, the user may unfold the top flap 26 from its removable attachment at the distal end from the exterior of the device 10 or 11, and therein hold the device 10 or 11 in front of their body as a shield by gripping the handle 52 with a hand and elevating their hand in the air over their head. This provides protection from the shield 30 in the top flap 26 and the shield 30 attached to one or both of the forward wall 18 and rear wall 16.

Further protection may be afforded by the addition of a deployable bottom flap 28 having the appropriate shield 30 attached concurrently with the deployment and elevation of the top flap 26. Such a deployment would yield a length of protection substantially longer than the bag by itself and possibly the entire body of the user if the top flap 26, bottom flap 28, and forward wall 18 and/or rear wall 16 are all of a length when combined to yield a full body length of the user. When so deployed, the user would have the additional utility of a means for elevation of the device attached to the top flap 26 that allows the device to be held in front of the body of the user, while still protecting the user's hand from harm since it too would be behind the device and shielded. Of course, the handle might be attached to the bottom flap 28 also to provide a second grip point protected from harm, or instead of the top flap 26 should the situation necessitate such.

Both the top flap 26 and the bottom flap 28 would be attached at one end to the container which is formed by the forward wall 18 joined to the rear wall 16 by direct attachment or communicating with the sidewalls 14. The other, or distal end of the bottom flap 28 would in the best mode include a means for releasable attachment to the exterior of the device in the form of a cooperating fastener such as hook and loop fabric 56 or cooperating metal fasteners 58 attached to the exterior of the device and the bottom flap 28. This would allow the bottom flap 28 to be raised out the way and stored when not in use rather than having it hang in a downward position. The top flap would in the best mode also employ the use of a cooperating fastener at the distal end opposite the end attached to the device if secure closure over the orifice 22 which communicates with the interior compartment 12 is desired. However, the top flap 26 would usually remain over the orifice 22 from simple gravity once placed in such a position so the addition of the means for releasable attachment to the distal end would provide more security against hands slipping into the device by keeping the top flap 26 more secure over the orifice 22.

While all of the fundamental characteristics and features of the bag style container with bullet resistant deployable panels device herein disclosed have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A combination container for transporting articles and ballistic shield comprising:

a bag, said bag having a forward wall and a rear wall each having upper and lower edges, means for joining peripheries of said forward wall and said rear wall, to form a compartment therebetween, and forming an orifice at said upper edges providing communication to said compartment, at least one ballistic shield, said ballistic shield comprised of material sufficient to shield the user from anticipated high speed projectiles, said ballistic shield attachable to one or both of said forward wall and said rear wall;

means of attachment of said ballistic shield;

carrying means attached to said bag;

an upper flap attached at a first end to one of said upper edges; and a deployable ballistic shield, said deployable ballistic shield attached to said upper flap, said deployable balistic shieled comprised of bullet resistant textile fabric;

whereby a user of said bag may employ said bag to carry articles therein and concurrently be shielded from high speed projectiles by said ballistic shield and said deployable ballistic shield.

2. The device as defined in claim 1 additionally comprising:

a lower flap attached at one end to one of said lower edges;

at least one additional ballistic shield, said additional ballistic shield attachable to said lower flap using said means of attachment of said ballistic shield.

3. The devices as defined in claim 1 additionally comprising:

said upper flap deployable to an elongated position; and means to hold said bag in an elevated position with said upper flap in said elongated position.

4. The device as defined in claim 3 wherein said means to hold said bag in an elevated position is a handle attached adjacent to a distal end of said upper flap.

5. The device as defined in claim 1 wherein said means of attachment of said ballistic shield is a shield pocket, said shield pocket sized to accommodate said ballistic shield and constructed upon the wall surface to which said ballistic shield is mounted.

6. The devices as defined in claim 1 wherein said ballistic shield is comprised of bullet resistant textile fabric.

7. The device as defined in claim 1 wherein said ballistic shield is comprised of one or a combination of materials from a group consisting of high density plastic, steel, aluminum, resin composite material, and titanium.

8. The device as defined in claim 2 additionally comprising means of releasable attachment of the distal end of said lower flap to said bag.

9. The devices as defined in claim 1 wherein said bag is a backpack, said carrying means being a plurality of straps affixed to said bag said plurality of straps dimensioned to support said bag on the shoulders of a user during transport.

10. The device as defined in claim 1 wherein said bag is a purse, said carrying means being a carrying strap attached adjacent to said upper edges of said bag.

11. The device as defined in claim 1 wherein said bag is a computer carrying case, said compartment dimensioned to hold a portable computer therein.

12. The device as defined in claim 2 wherein said bag is one of a backpack, a purse, or a computer carrying case.

13. The device as claimed in claim 1 additionally comprising a means of blunt force absorption located adjacent to said ballistic shield.

* * * * *